United States Patent [19]

Krall et al.

[11] 4,274,097

[45] Jun. 16, 1981

[54] EMBEDDED DIELECTRIC ROD ANTENNA

[75] Inventors: Albert D. Krall, Rockville; Albert M. Syeles, Silver Spring, both of Md.

[73] Assignee: The United States of America as represented by the Secretary of the Navy, Washington, D.C.

[21] Appl. No.: 132,457

[22] Filed: Mar. 21, 1980

Related U.S. Application Data

[63] Continuation-in-part of Ser. No. 565,292, Mar. 25, 1975, abandoned.

[51] Int. Cl.[3] ..... H01Q 13/24

[52] U.S. Cl. ..... 343/719; 343/785; 343/873

[58] Field of Search ..... 343/785, 873, 719, 872, 343/854

[56] References Cited

U.S. PATENT DOCUMENTS

| | | | |
|---|---|---|---|
| 3,128,467 | 4/1964 | Lanctot | 343/785 |
| 3,518,683 | 6/1970 | Jones | 343/783 |
| 3,818,333 | 6/1974 | Walker | 343/785 |
| 3,858,214 | 12/1974 | Jones | 343/785 |

*Primary Examiner*—Eli Lieberman

*Attorney, Agent, or Firm*—R. S. Sciascia; A. L. Branning; D. A. Lashmit

[57] ABSTRACT

A compact, directional antenna element for achieving narrow beamwidths and wide bandwidths. The element is formed from a polyrod having a high dielectric constant embedded in a wave guide made of a second medium having a dielectric constant slightly lower than that of the rod.

25 Claims, 15 Drawing Figures

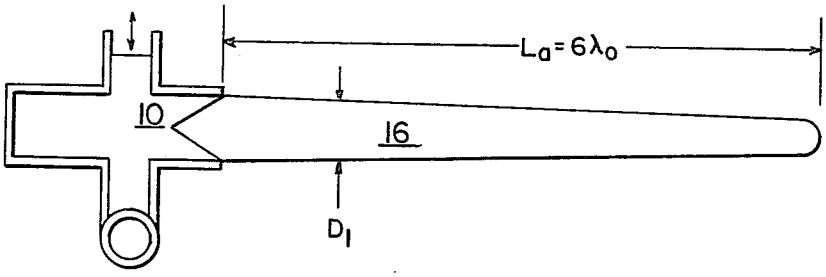
PRIOR ART
FIG. 1
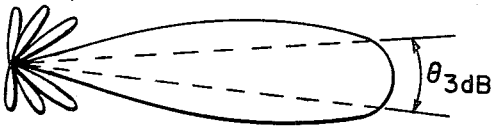
FIG. 1A
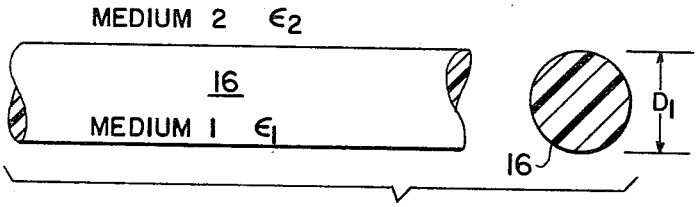
FIG. 1B
FIG. 1C
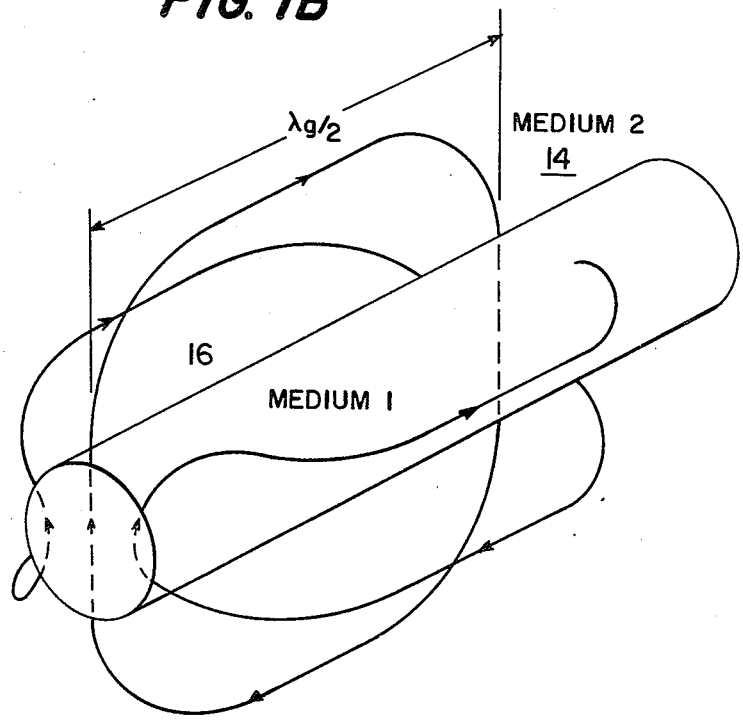

EMBEDDED DIELECTRIC ROD ANTENNA

CROSS-REFERENCE TO RELATED APPLICATIONS

This application makes reference to a parent patent application by the same inventors earlier filed in the Patent and Trademark Office of the United States on the 25th of March 1975 and is a C-I-P and assigned Ser. No. 565,292, now abandoned, for the purpose of obtaining those benefits bestowed by 35 U.S. C. 120.

BACKGROUND OF THE INVENTION

The present invention pertains generally to electronically scanned antennas and more particularly to the polyrod type of directive antenna element. An outstanding problem in naval fire control is the simultaneous tracking of multiple targets. This problem is partially solved by the use of electronically scanned antenna arrays. Due to the cost and complexity of mutual impedance and computerized steering commands, the use of these arrays has been fairly limited in the fleet.

Another configuration has a series of single radar beams produced by directive antenna elements which are serially addressed in accordance with their placement, thereby providing a steered beam. End-fire directive antenna elements have advantages over alternative types of beam directors such as parabolic reflectors, lenses, and antenna subarrays since end-fire elements occupy considerably less cross-sectional surface area. The actual length of an end-fire element however, has virtually eliminated their use.

The electromagnetic waves that can exist on a dielectric rod were first solved by Hondros and Debye and published in the Annelen der Physik, volume 32, number 8 (1910) in an article entitled Electromagnetische Wellen an dielektrischen Drachen, pages 465 through 476. The general theory of these modes was extended by Carson, Mead, and Schelkunoff in Hyper-frequency Waveguides—Mathematical Theory, BSTJ volume 15, page 310 (April, 1936).

U.S. Pat. No. 2,425,336, issued on the (12th of August 1947 to G. E. Mueller describes the first application of this theory in the form of a directive dielectric antenna. Following the second World War, an electronically steerable array of forty-two dielectric antennas was applied to the fire control of a U.S. Navy radar; the antenna design theory was published by Mueller and Tyrrell in a paper titled Polyrod Antennas, BSTJ volume 26, page 837 (October, 1947). The theory was based on the premise that the wave on the rod leaked as it traveled down the rod. By varying the rod diameter and the dielectric constant of the rod, the phase of leaked radiation could be adjusted in such a manner that it added constructively in the forward direction to produce a beam. Antennas could be designed that were reasonably close to practice as long as the beam widths were greater than 20 degrees. Many workers in this country and abroad have continued with this approach but failed to produce significant advances. Following the publication by Kao, Dielectric Surface Waveguides, URSI General Assembly, Ottawa, Canada, in paper 6-3.2, August 18 through 28, 1969 and the subsequent work in the field of fiber optics (dielectric rods), the basic theory became wide spread. This theory and the many confirming experiments have demonstrated that the dominant electromagnetic mode used on the antenna does not leak as it travels the rod. An alternate approach to the radiation mechanism has been developed with the electromagnetic field distribution existing around the distal end of the antenna regarded as an aperature. The extent of this field distribution determines the aperature size which in turn determines the far field radiation pattern. Zucker first recognized this approach (Theory and Application of Surface Waves, Nuovo Cimenti Suppl., volume 9, page 451, 1952); it was further expanded by Yahjian and Korhauser (A Modal Analysis of the Dielectric Rod Antenna Excited by the $HE_{11}$ Mode, IEEE Transactions AP-20, number 2, page 122, March, 1972) and Zucker (Antenna Theory, Part 2, Chapter 21, McGraw-Hill, N.Y.) in the United States, Brown and Spector (The radiating Properties of End-fire Aerials, Proceedings of the IEE, 104B, page 27, 1957) in England, and E. G. Neumann (Uber das Electromagnetische Feld am Freiden Ende einer Dielektrischen Lietung I. Abstrahlung, Z. Angen Phys. 24, page 1, 1967) in West Germany In studying the physical characteristics of end-fire dielectric rod antennas (i.e., "polyrods"), diffraction theory indicates that if D represents the maximum rod diameter and $\lambda$ the responsive antenna wavelength, then the minimum angle $\theta$ of the antenna beam within which radiation can be concentrated is proportional to $\lambda/D$. To achieve small angles, therefore, $\lambda$ must be small and D large. Both $\lambda$ and D are constrained however, by other system characteristics. The wavelength, $\lambda$, is basically restricted in radar to a limited range of wavelengths. Therefore, the only method of restricting the angle $\theta$ is to increase the actual length, $L_a$, of the rod. By making $L_a$ large in a discrete elemental linear array and phasing the array for end fire (i.e., lining up a series of dipole elements and phasing each successive dipole by 90° so that the beam is emitted along the line of the array), the cross-sectional dimension of the array is made independent of the actual length of the array and is restricted by only the length of a single antenna element—usually on the order of a wavelength or less which, for I band, is about three centimeters.

Dielectric rods are ideal substitutes for the directive antenna elements in a linear phased array since they are easily phased for end fire and, by their design, can be constructed of any one of a number of low loss dielectric materials available and easily matched for impedance over a wide range of frequencies.

The half power beam-width (HPBW) of dielectric rod antenna indicates that:

$$\theta_{3db} = HPBW(\text{degrees}) \simeq \frac{60}{\sqrt{\text{length of rod in free space measured in wavelengths}}}.$$

Using I band ($\lambda=3$ cm), a 6° HPBW requires a rod having an electrical length of approximately three meters (~10 ft). Even if the Hansen-Woodyard supergain relation is applied, a ten foot pole could either be used to produce a 4° beam or reduced to a seven foot pole to retain a 6° HPBW beam. A seven foot pole however, is still too long for use in a phased array.

SUMMARY OF THE INVENTION

The present invention overcomes the disadvantages and limitations of the prior art by providing a short length, narrow beam-width, dielectric rod antenna element. The antenna element of the present invention comprises a rod having a high dielectric constant surrounded by a medium having a dielectric constant slightly lower than that of the rod. The result of embedding the rod in this manner is that the electrical wavelength of the antenna is lengthened by the square root of the waveguide's dielectric constant. The physical length of the antenna can therefore be shortened by the square root of the dielectric constant.

It is therefore an object of the present invention to provide an improved directive antenna element.

It is also an object of the present invention to provide a high gain antenna element.

Another object of the present invention is to provide a broad bandwidth antenna element.

Another object of the present invention is to provide a short length, narrow beamwidth, end-fired antenna element.

Other objects, advantages and novel features of the invention will become appararent from the following detailed description of the invention when considered in conjunction with the accompanying drawings wherein:

BRIEF DESCRIPTION OF THE DRAWINGS

FIG. 1 is a side view of a prior art polyrod design.

FIG. 1A is a cross-sectional view along the longitudinal axis of the polyrod in FIG. 1, showing the three decibel beam pattern.

FIG. 1B is a side view showing the boundary used for solution of Maxwell's equations to determine which electromagnetic waves can exist in the vicinity of a dielectric rod.

FIG. 1C is an isometric view of a section of a cylindrical polyrod showing the electric field lines of the dominant electromagnetic mode.

DETAILED DESCRIPTION OF THE EMBODIMENTS

Figure 2:
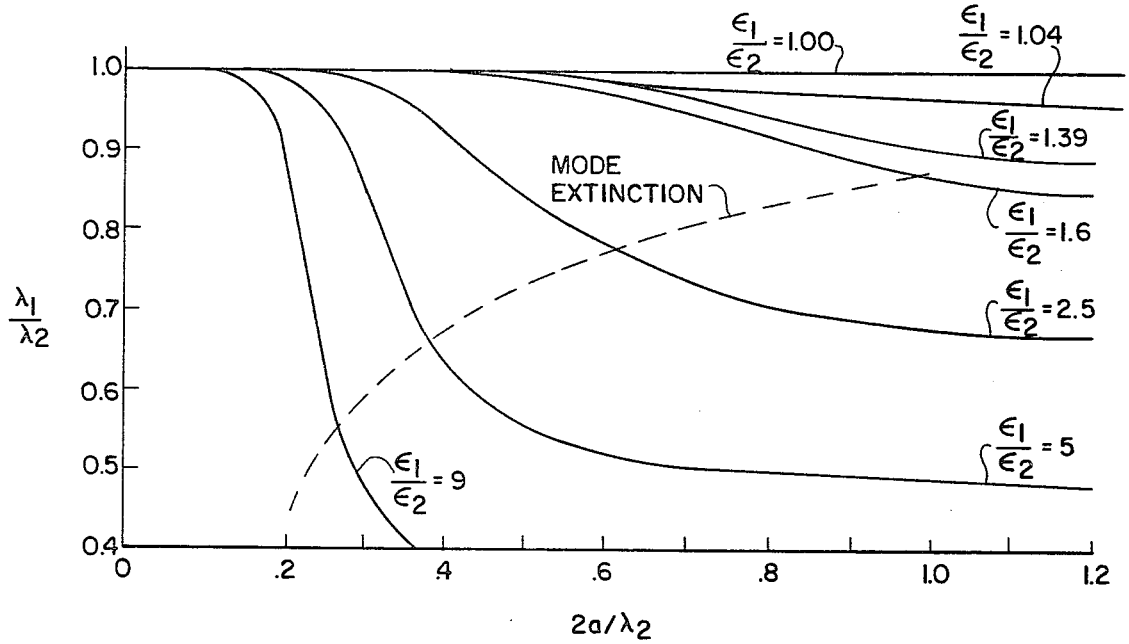
FIG. 2 is a graph showing the ratio between the diameter of a polyrod and the wavelength external to the polyrod plotted along the abscissa and the phase velocity plotted along the ordinate, to show the dominant mode dispersion curves for six different ratios between the dielectric constant of medium 1 and that of medium 2.

An electromagnetic wave can be launched on a dielectric rod and utilized as a transmission line (e.g., fiber optics) or an antenna (e.g., polyrod). The basic equations and solutions for the existence of an electromagnetic wave on a dielectric are well documented. FIG. 1 illustrates the prior art design for a polyrod antenna. Implied is the use of polystyrene ($\epsilon_1=2.56$) for dielectric rod 16 and excitation of $HE_{11}$ mode on the rod. The beamwidth, $\theta_{3dB}$, as shown in FIG. 1A, is a function of the length, $L_a$, of rod 16 as long as $L_a$ is less than nine wavelengths. Antennas with rods longer than $9\lambda_o$ continue to have a beam width of approximately twenty degrees. The rod diameter, $D_1$, is, as explained below, emperically determined to preclude excitation of higher order modes.

FIG. 1B is a sketch of the boundary taken between medium 1 of the polyrod and medium 2 of the surrounding environment, in this instance, air ($\epsilon_2=1.0$), to show that electromagnetic waves can exist in the vicinity of a dielectric rod. The mathematics involved in solution of Maxwell's equations for the boundary conditions are given in Optical Waveguides, Chapter 4, by Kapany and Burke, Academic Press, and in Performance of Polymer Waveguide at Milimeter Wavelengths, by Jablonski, Krall, VanSant and Syeles, NSWC/WOL TR77-115, May 1978, and will not be repeated here. FIG. 1C is a sketch of the electric field lines of the dominant $HE_{11}$ mode on a polyrod 16 showing how the fields exist beyond the rod in the surrounding medium 2.

From the solutions for the various modes that can exist a dominant can be found. Similar to the dominant mode in coaxial cables, this mode, called the hybrid or the dipole or the $HE_{11}$ mode, can propagate no matter how small the rod radius is. The critical radius below which only the $HE_{11}$ can exist is given by the root of the zero order Bessel function whose argument is:

$$X = \frac{2\pi a}{\lambda_2}\left[\frac{\epsilon_1}{\epsilon_2} - 1\right]^{\frac{1}{2}} = 2.405 \qquad (1)$$

where a=radius of the dielectric rod $\lambda_2$=wavelength in region surrounding the rod.

Figure 3:
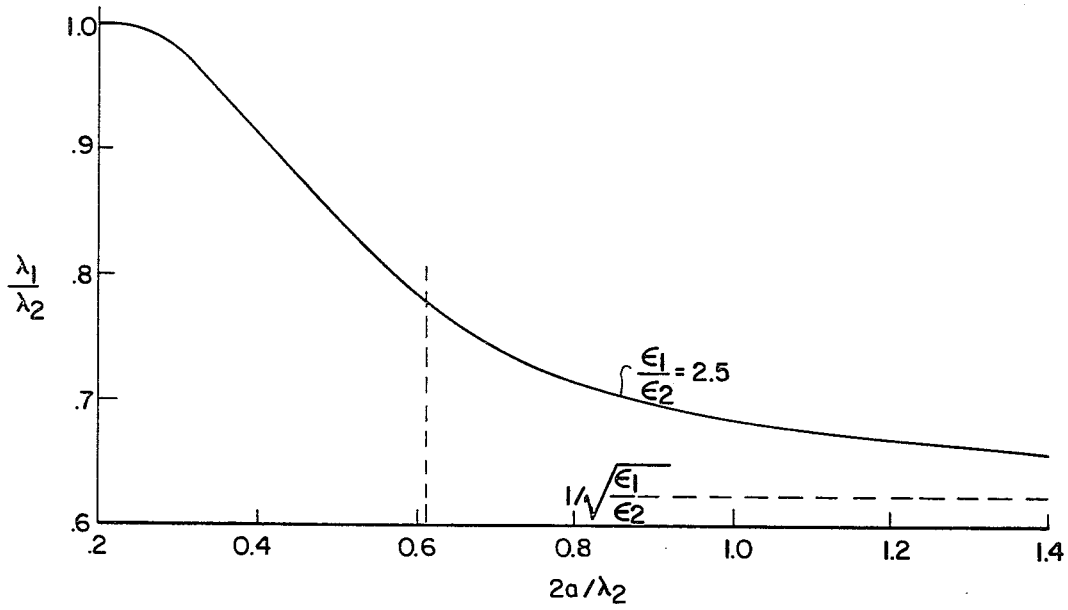
FIG. 3 is a simplified replot of the graph shown in FIG. 2 with a single dispersion curve.

Equation 1 shows that the extinction of the higher order modes is a function of the rod radius, the wavelength outside the rod, and the relative dielectric constant between the rod and its surroundings. The guidance condition for the $HE_{11}$ mode is plotted in FIG. 2. The normalized wavelength on the rod is plotted against the normalized rod diameter as a function of various relative dielectric constants. The dotted curve, the mode extinction curve, comes from Equation 1 and the region to the left of it can only support the $HE_{11}$ mode. It can be seen from FIG. 2 that as the relative dielectric constant increases, the slope of the curves also increases. With an increased slope, a small change in driving frequency will produce a large change in phase velocity of the wave excited on the rod. Wide band antennas therefore, should be built from low relative dielectric constant materials. In the past, most of antennas have been fabricated from polystyrene, a material with a dielectric constant relative to air of about 2.5. To be able to make comparisons we shall continue to use this value. FIG. 3 is a replot of FIG. 2 with only this value. From FIG. 3 is can be seen that for large diameter antennas the mode wavelength approaches asymptotically the wavelength it would have if traveling entirely inside the rod. For very small diameters the mode approaches the wavelength it would have traveling entirely outside the rod (i.e., entirely in medium 2). The former is the tightly bound condition where the wave energy resides within or nearby the rod; it can be excited efficiently. The latter is the loosely bound condition where energy spreads away from the rod and couples easily to radiation modes. A polyrod antenna is designed to operate in the region between these two extremes. The diameter may be compromised so that both excitation remains reasonably efficient and the field extends enough to produce a reasonable aperature.

Figure 4:
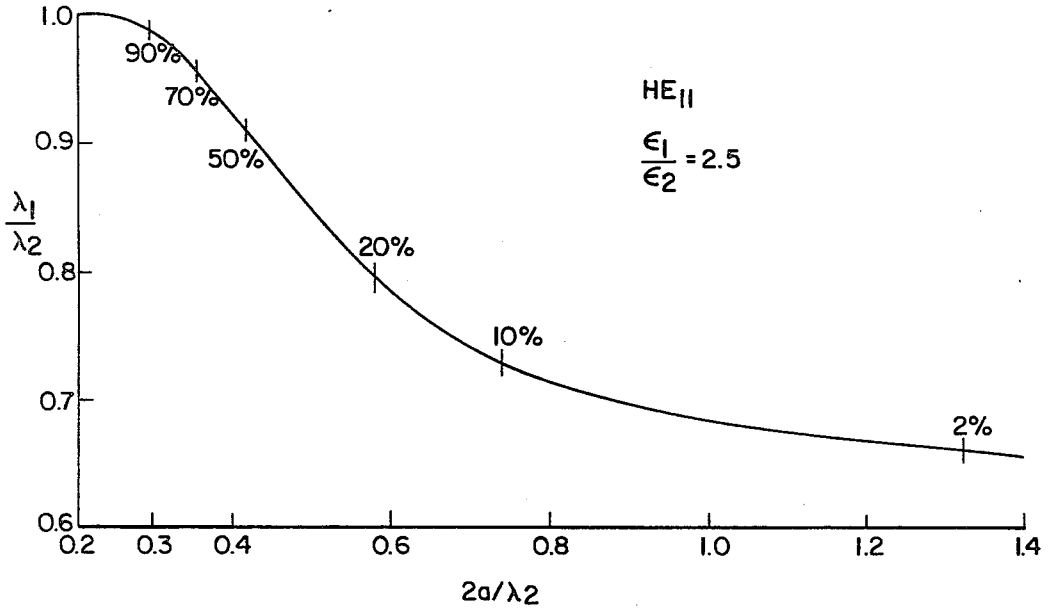
FIG. 4 is a simplified replot of the graph shown in FIG. 2 with a single dispersion curve graduated to show percentage of energy external to a polyrod.
Figure 5:
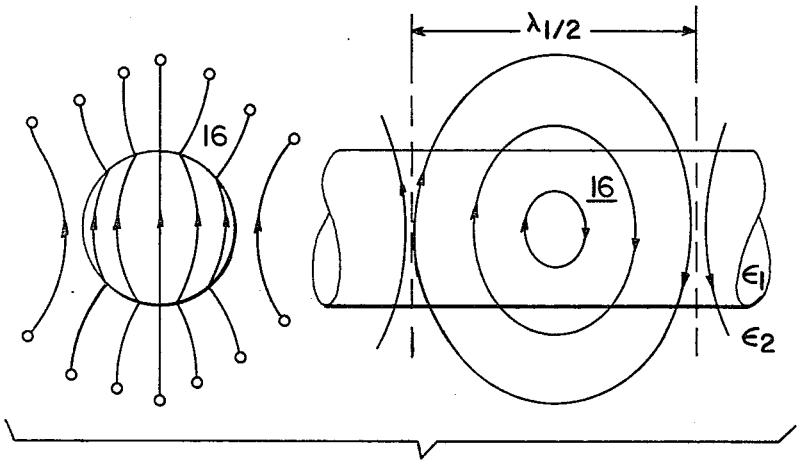
FIG. 5 is a cross-sectional view adjacent to an end view, both views showing the electric field distribution around a polyrod.
Figure 6:
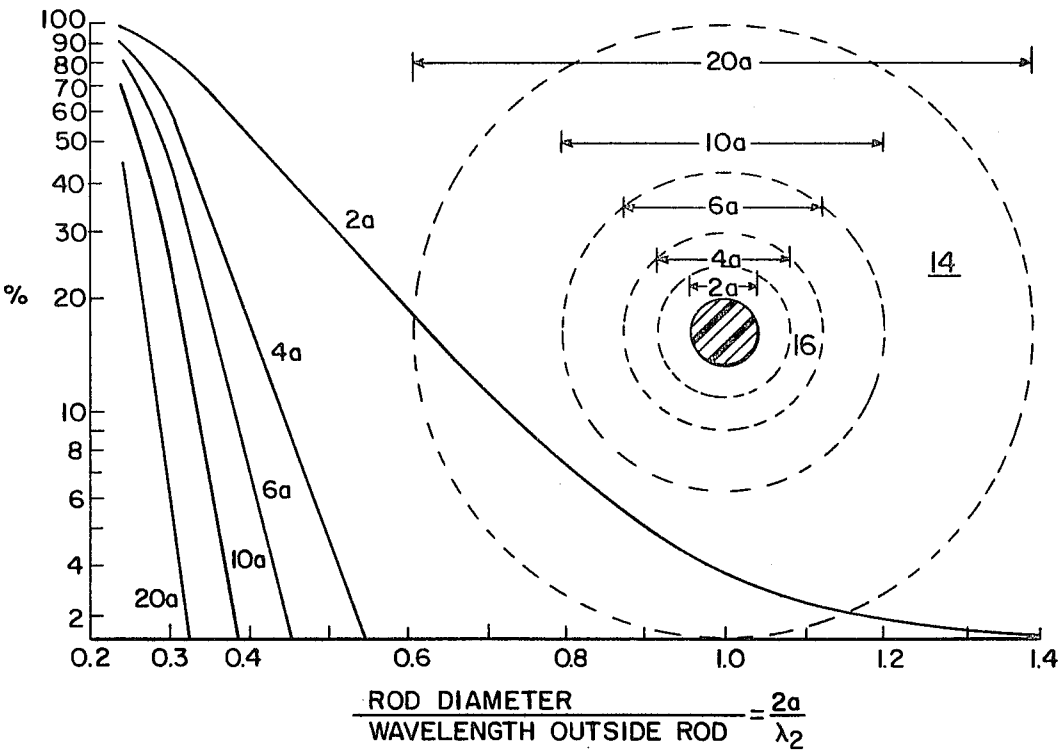
FIG. 6 is a graph with the ratio between the diameter of a polyrod and the wavelength external to the polyrod plotted along the abscissa and the percentage of energy external to the polyrod plotted along the ordinate, for imaginary cylindrical surfaces of five different diameters coaxial with the polyrod.

The extent of the field external to the rod is exhibited in FIG. 4. It can be seen from FIG. 4 that if $2a/\lambda_2=0.612$ (i.e., if the value of $2a/\lambda_2$ is below extinction of higher order modes), then at least 20% of the energy will be external to the rod. For an antenna design more information than this is needed. It is necessary to know how and where this energy is distributed. The electric field distribution around the rod is shown in FIG. 5. In general, it is necessary to create a field configuration at the launching point that is close to the desired mode field configuration if efficient excitation is to be expected. The cross-sectional view of FIG. 5 (from Computer-Graphic Analysis of Dielectric Waveguides, IEEE Transactions, MIT, page 187, March 1967) illustrates the desired fields. The quantitative distribution of the energy around the rod has been calculated and is shown in FIG. 6. It can be seen in FIG. 6, just as in FIG. 4, that for a cylinder 14 of the same diameter as the rod (i.e., $D_2=2a$) and for a rod of $2a/\lambda_2=0.612$ (i.e. extinction), 20% of the energy in the wave is external to the rod. Curve 4a however, does not have an abscissa value of $2a/\lambda_2=0.612$ on the plot. Less than two percent of the energy is therefore external to an imaginary cylinder (i.e., media 2) 14 with a diameter 4a; 18% of the energy in the wave is between the rod and the outer diameter of the imaginary cylinder 14 while 80% is within the rod itself. A similar calculation for smaller diameter rods reveals that the energy not only spreads but that its distribution is approximately binomial.

EXAMPLE 1

Consider a polyrod designed to provide a beamwidth of 20° at a frequency of 4 gigahertz ($\lambda_o=7.49$ cm.). The necessary aperture may be calculated from the beamwidth and the rod diameter calculated from the aperature. Transition between the coaxial feed and the excitation end of the polyrod will be considered from these dimensions. Note that the 4 gigahertz frequency, chosen purely on the basis of laboratory convenience (i.e., economy of time and funds), is more than one order of magnitude higher than the frequency for which a polyrod antenna is likely to be used. Scaling of frequency to lower values is considered trivial because theory readily allows scaling while dielectric material as a general rule operate more favorably at lower frequencies.

For the distribution of a dipole wave ($HE_{11}$) on a polyrod, Neuman (i.e., Radiation Mechanism of Dielectric Rod and Yagi Aerials, Electronic Letters, volume 6, number 16, August, 1970) gives the directive gain as:

$$D(\psi,\theta)=[1+(2\pi r_o\theta/\lambda_2)^2]^{-2} \tag{2}$$

where $\theta$ is the angle between the axis of the antenna and the observation point, and independence of angle $\psi$ is assured by mode symmetry. The variable $r_o$ determines the extent of the surface wave across the assumed aperature at the end of the dipole. From (2) the 3 dB beamwidth in degrees can be calculated as:

$$\theta_{3db} = 11.7\frac{\lambda_2}{r_o} \tag{3}$$

for a 20° beamwidth and a wavelength in medium 2, assuming medium 2 to be air, of 7.49 centimeters, equation (3) yields $r_o=4.38$. The value of $r_o$ is directly connected to the wave numbers in medium 1 and 2 through the relationship:

$$r_o=\left[\left(\frac{2\pi}{\lambda_1}\right)^2-\left(\frac{2\pi}{\lambda_2}\right)^2\right]^{-\frac{1}{2}} \tag{4}$$

Solving this equation for $\lambda_1/\lambda_2=0.965$ yields the phase velocity that is needed to enter the dispersion curve of FIG. 3. From this value, curve in FIG. 3 indicates that the required rod diameter is $2a=0.34\lambda_2=2.5$ cm.

As a check on these results, $2a/\lambda_2=0.34$ is entered on FIG. 6 to which show that less than 1% of the mode energy is external to an imaginary circle whose diameter is 25 centimeters and coaxial with rod 16. If the distribution of FIG. 6, which is nearly binomial, is used to calculate the half-power beamwidth, then:

$$\theta_{3db}\text{ (Binomial Dist.)} = \frac{39}{\sqrt{20a/\lambda_2}} = 21° \tag{5}$$

This confirms the original calculation.

Figure 7:
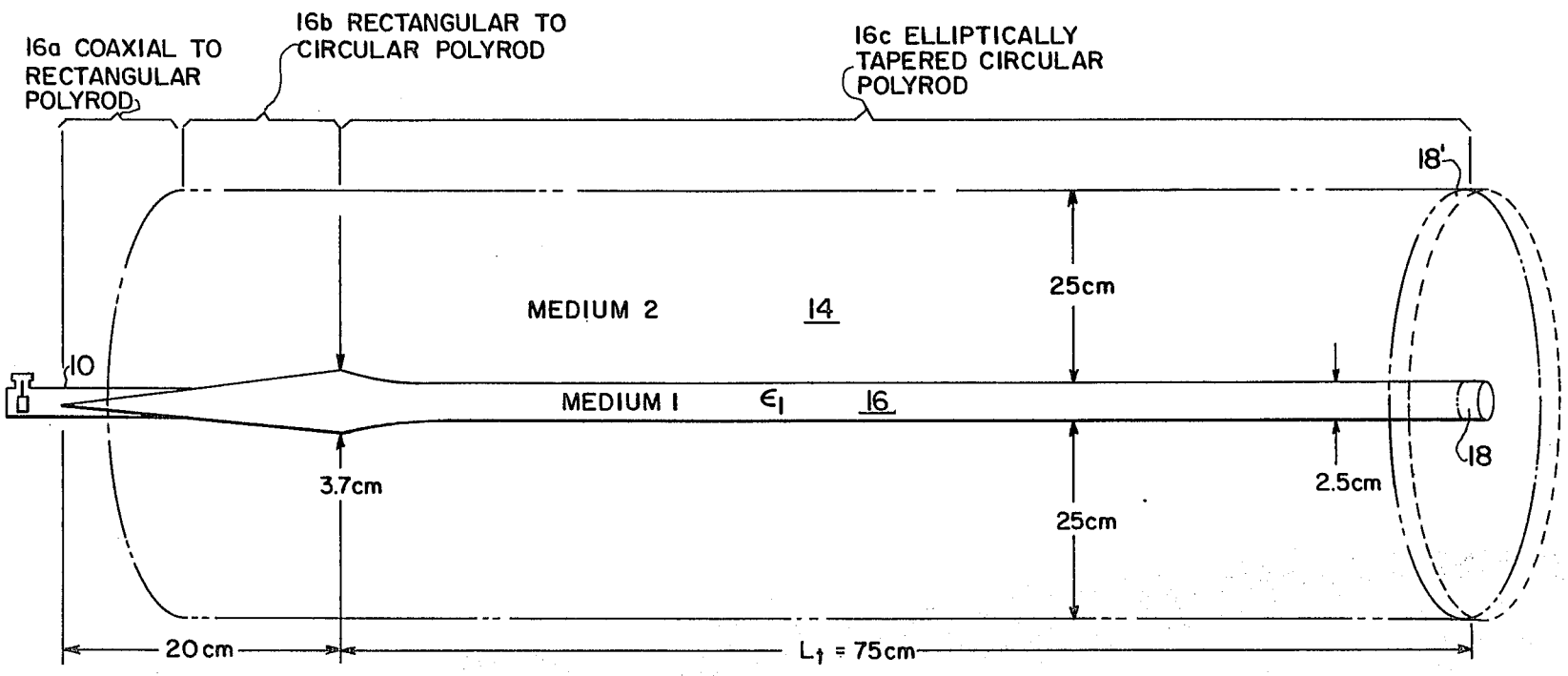
FIG. 7 is an isometric view of one embodiment of a polyrod end-fire element surrounded by a second dielectric medium.
Figure 7A:
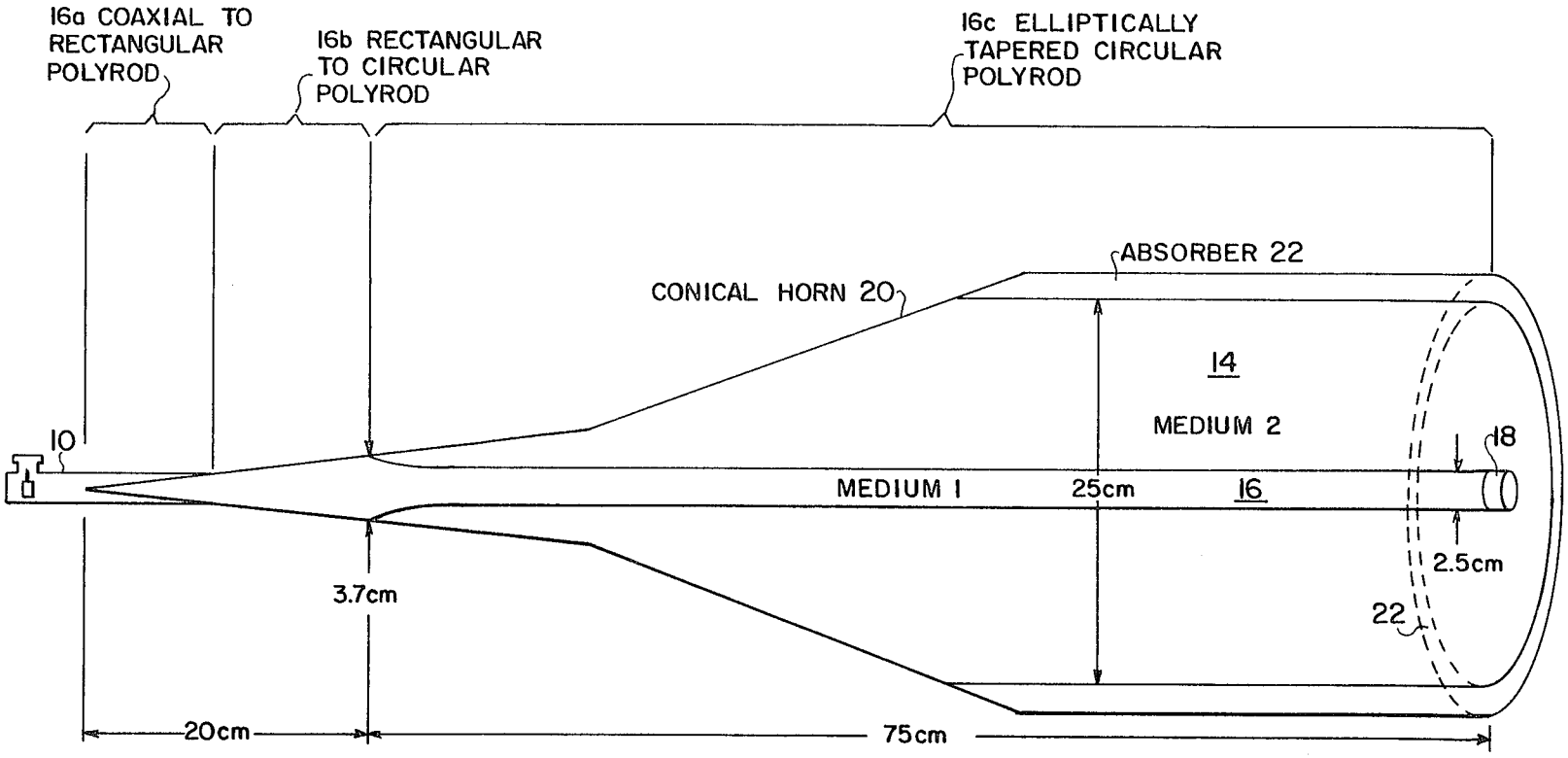
FIG. 7A is an isometric view of the polyrod shown in FIG. 7 surrounded by a second dielectric medium and a conical horn.

The diameter of the polyrod antenna at 4 gigahertz is now fixed at 2.5 centimeters, as shown in the sketch in FIG. 7. If the $HE_{11}$ mode could be excited from a source of 4 gigahertz on a short section of the rod with 100% efficiency, the design would be finished. Unfortunately, it is not possible. Efficiency of excitation from common transmission lines can reach values as high as 80%. This is done with rod diameters differing from that calculated to produce a 20° beamwidth. The transition from excitation diameter to radiation diameter must be done with care because it is possible to radiate unwanted patterns if care is not taken. The length of the antenna is determined so as to avoid this effect. There has been some theoretical work which predicts efficiencies of exciting the $HE_{11}$ mode on a polyrod of between 63% to 80%. Experimentally, most of the polyrods have been excited from rectangular waveguides and have reported efficiencies of between 84% to 90%. Referring now to FIG. 7A, a side view of a polyrod designed with those dimensions calculated in Example 1 and shown in FIG. 7, we shall follow Schulten (Applications of a Dielectric Line, Phillips Technical Review, volume 26, number 11, 12 page 350, 1965) who starts with a tapered rod in a rectangular waveguide, section 16a, makes a transition to a circular waveguide, section 16b, and then to a conical horn, section 16c. It has been our experience that the VSWR in the waveguide can be held below 1.1 throughout the guide bandwidth. The transition to circular guide $TE_{11}$ mode from the rectangular $TE_{01}$ mode aids in orienting the maximum electric field lines in coincidence with those of the dielectric $HE_{11}$ mode shown in FIG. 5. The conical horn will be extended with a 20° flare angle until its aperature is 25 centimeters diameter to provide a smooth transition and eliminate back radiation. The value 25 centimeters was determined by the 99% energy aperature criterion.

For maximum efficiency of mode excitation, Yip (Launching Efficiency of the $HE_{11}$ Surface Mode on a Dielectric Rod Waveguide, IEEE Transactions MIT-18, number 12, page 1033, December 1970) choose $2a/\lambda_2=0.5$ requiring a rod diameter of 3.7 centimeters. An abrupt transition from this diameter to 2.5 centimeters at the radiation end would cause undesired radiation. A gradual taper will reduce this undesired radiation. Since the fields are more loosely coupled at small diameters however, it is reasonable to expect that a linear taper, in a region of small diameter, will produce greater radiation than would the same linear taper in a region of large diameters. The solution is to use an exponential taper with the greatest change on the taper occuring at the largest diameter. The radiation losses can then be made as small as desired simply by extending the length of the taper. The problem here is to choose the smallest possible antenna length. With a transition length $L_t=10\lambda_2=75$ centimeters, the relative losses of the exponential taper, compared to an abrupt step, are down about 10 dB. Under the foregoing choices, the exponential taper is given in the form:

$$a(Z)=1.25+0.60e^{-.0.06Z} \quad (6)$$

With this information the basic antenna design is complete. In FIG. 7A an absorber 22 and a cap (quarter-wave transformer) 18 on the end of polyrod 16 have been added. Since ninety-nine percent of the power is within a twenty-five centimeter diameter of the longitudinal axis of rod 16, the absorber will only affect the remaining one percent of the power of the desired mode. Power in the circular waveguide that is not transformed into the $HE_{11}$ mode, about fifteen percent, will also radiate and cause sidelobes in the main beam pattern. The absorber is used to eliminate much of this power. The end cap 18 on the polyrod is normally absent from prior art end-fire directive antenna design. FIG. 6 however, indicates that approximately twenty-five percent of the energy is within rod 16; to avoid unwanted reflections at the end, quarter-wave transformer 18 is installed as a matching section.

The total losses expected in the antenna shown in FIG. 7A are less than 2 dB. At the coaxial transition to rectangular waveguide, using commercially available equipment, the VSWR is less than 1.25. The tapered dielectric will not increase this appreciably. Therefore, less than 2% of the energy should be lost. At the circular waveguide to dielectric mode conversion at least 80% efficiency is expected (20% loss). The absorber will take 1% from the fields of the mode and the dielectric losses due to displacement currents amount to less than 1%. A total of these factors is between 1 dB and 2 dB.

For the benefit of those unacquainted with the electrical arts and more particularly, with the distinctions between those materials classified as insulators and conductors and those materials having electrical properties which allow them to be characterized as dielectric, the following table of exemplary dielectric materials is set forth.

TABLE

| | Dielectric Constant | Loss Tangent × $10^4$ |
|---|---|---|
| $TiO_2$ | ~100 | 5.2 |
| $BaTiO_2$ | ~1200 | 75–500 |
| $CaTiO_2$ | ~167 | 3.1 |
| $SrTiO_2$ | ~225 | 1.0 |
| $BaTi_9O_{20}$ | ~50 | 200 |
| 79%($BaTi_9O_{20}$) 21%($SrTiO_2$) | ~800 | 700 |
| Distilled Water | 87–55 | 0.04 |
| Sea Water | 76–70 | 100 |
| Ceramic NPOT96 (American Lava Co.) | 29.5 | 12–2 |
| $MgTiO_2$ | 13.9 | 15–5 |
| Glycol | 37.7 | 0.224 |
| Nitrobenzene | 34.8 | 0.225 |

These values listed are for frequencies on the order of $10^8$ Hertz. A more complete list of dielectric materials suitable for construction of the double dielectric antenna disclosed here is compiled in Dielectric Materials and Applications by A. R. vonHippel, Technology Press of M.I.T. and John Wiley & Sons, as well as in the CRC Handbook of Chemistry And Physics. The moisture absorption of these materials is typically either zero or negligible. It is a well known technique to vary the composition of mixtures such as those listed in the Table, and thereby change the dielectric constant.

EXAMPLE 2

The polyrod just considered and the accompanying theory were in terms of the parameters $\epsilon_1/\epsilon_2$ and $\lambda_1/\lambda_2$. If $\epsilon_1$ and $\epsilon_2$ are now changed with the ratio $\epsilon_1/\epsilon_2$ fixed, the wavelengths change. By choosing $\epsilon_1=25$ and $\epsilon_2=10$ (e.g., lead monoxide, $\epsilon_1\simeq25.9$ and aluminum oxide, $\epsilon_2\simeq10.0$, respectively, or alternately, two different volume-percentage mixtures of rutile), wavelength $\lambda_2$ is reduced by 3.16, the square root of $\epsilon_2$. Referring back to FIG. 2 where the electric field lines are shown as existing beyond rod 16 (i.e., medium 1) and into the surrounding medium 2; it is this phenomenon that permits control of the wavelength size, $\lambda_2$, by the external medium 2. The amplitude of the wave dies off with distance from the center of the rod, thereby allowing for a design of finite extent with an external medium other than air. The dimensions derived for the polyrod shown in FIG. 7 where determined for a medium 2 with a dielectric constant of 1.00; if medium 2 is changed to a material with a dielectric constant of 10 and substituted for the air used in Example 1 to fill the twenty-five centimeter radius of cylinder 14, the device shown in FIG. 7 will effectively become a double dielectric antenna and all dimensions given will be reduced by a factor equal to the square root of ten. There are two differences between the polyrod discussed earlier and the double dielectric antenna proposed here. First, the mode energy is largely contained in medium 2, a material with a dielectric constant of ten, and must be matched to air to assure efficient radiation. A quarter-wave matching plate 18 must be enlarged to cover the distal ends of both polyrod 16 and cylindrical sheath 14 of medium 2. Second, the losses of the antenna change because of the presence of the dielectric material surrounding the rod. Attenuation on the antenna is given by equation (6), a modification of an equation published in Attenuation in a Dielectric Circular Rod, by W. Elsasser in Journal of Applied Physics, volume 20, page 1192 in December, 1949, that is modified to fit a double dielectric antenna.

$$\text{ATTENUATION} = 2729\left[\frac{\epsilon_1^{\frac{1}{2}}}{\lambda_2}\tan\delta R + \frac{\epsilon_2^{\frac{1}{2}}}{\lambda_2}\tan\delta_2\left(\frac{1}{\epsilon_2^{\frac{1}{2}}} - R\right)\right]^{dB/m} \quad (6)$$

Inserting appropriate values for the materials that are to be used in constructing an antenna into this equation yields an attenuation of 4 decibels per meter. Since the length of the antenna has been reduced to something close to one-third of a meter, the total of the additional loss caused by the presence of sheath 14 amounts to 1.3 decibels. This factor could become larger for very high dielectric materials with large loss tangents (i.e., tan $\delta$). A compromise between antenna length and the extra radiation accompanying the length would then be in order. For this design however, the additional loss is insignificant.

The use of a quarter wave plate is expected to produce its effect on the overall bandwidth of the antenna. Again, it is used as a matter of convenience and wider bandwidth matching circuits could be used. Alternately, a Chebyschev impedance transformer could be installed in order to match the end of double dielectric antenna to the atmosphere.

EXAMPLE 3

Figure 8:
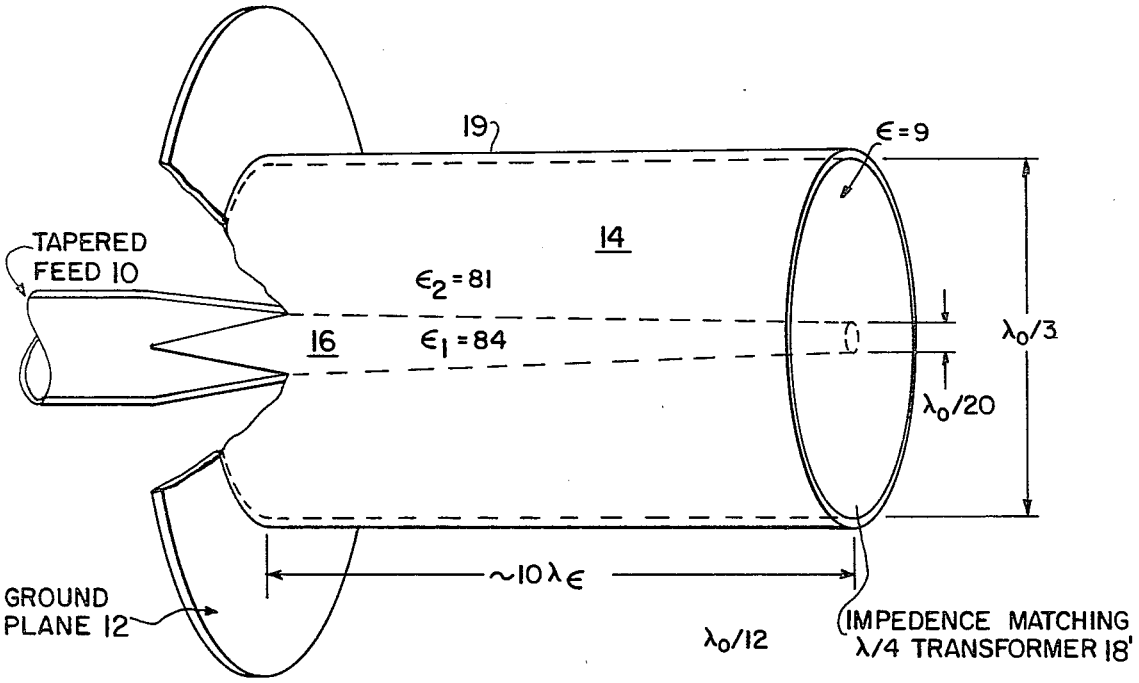
FIG. 8 is an isometric view of an alternate embodiment of a double dielectric antenna.

FIG. 8 discloses the elements of another embodiment of a directive antenna dielectric end-fire polyrod. A linearly tapered feed 10 supplied a radar signal across the ground plane 12 to the antenna element constituting a waveguide 14 and rod 16. The signal supplied by tapered feed 10 must be of the proper mode as, for example, the $HE_{11}$ mode to determine phase velocity and construct the rod 16 in the proper manner to cause end fire.

The effect of the waveguide 14 is to slow the propagation of the signal outside the rod. The wavelength $\lambda_\epsilon$ within any dielectric is equal to the wavelength in free space $\lambda_o$ divided by the square root of the dielectric constant $\epsilon$ of the material. Thus:

$$\lambda_\epsilon = \frac{\lambda_o}{\sqrt{\epsilon_2}} = \frac{\lambda_o}{9} \quad (7)$$

In the described embodiment then, where the dielectric constant of medium 2 (i.e., sheath 14) surrounding dielectric rod 16, has been selected as 81, the wavelength of the radar signal in the waveguide is reduced by a factor of 9.

Considering the HPBW equation again, the physical length of the rod is reduced by a factor of 9 since the length of the rod must be measured in wavelengths in the medium surrounding the rod and the wavelengths in the dielectric waveguide are 1/9 their length in free space. The ten foot pole of the prior art (dielectric rod 16) can therefore, if surrounded by a dielectric material having a dielectric constant equal to 81, be reduced in actual length to a rod just over a foot long while retaining its ten foot electronic length. Of course, material having higher dielectric constants can be used to even further reduce the length of the rod.

As also shown in FIG. 8, the antenna element has a quarter wave impedance matching transformer 18' which couples the antenna to the atmosphere for end fire. The transformer is one quarter wave length thick and has a dielectric constant equal to the square root of the product of the two mediums being matched, (i.e., the waveguide and the atmosphere). Since the atmosphere has a dielectric constant of 1, the dielectric constant of the transformer is 9.

The cross-sectional dimension of the antenna element including the waveguide has been selected to provide −40 dB mutual coupling with other antennas spaced one wavelength apart. Studies have shown that this coupling is provided by a crosssectional dimension of $\lambda_o/3$ which for I band would be about 1 centimeter, although smaller cross-sectional dimensions would most probably be acceptable. The diameter of rod 16 equals $\lambda/20$. The actual length of rod 16 equals $10\lambda_\epsilon$. Ground plane 12, shown partially cut away in FIG. 8, serves to image the radiating structure of double the dielectric antenna, mainly by suppressing the back lobe of the beam pattern. Without ground plane 12, the double dielectric antenna would have a back lobe at about −40 decibels down.

The structure shown in FIG. 8 has a polyrod 16 (medium 1) with a dielectric constant of 84, embedded in a sheath 14 (medium 2) with a dielectric constant of 81; it has a relative dielectric constant of 1.04. One material suitable for polyrod 16 is Ceramic N750T96, a ceramic commercially available from American Lava Company, ($\epsilon_1$=83.4 between $1\times10^2$ through $1\times10^{10}$ Hertz while tan $\delta$ varies from 5.7 to 14.6 over the same frequency range); sheath 14 could be made of the same material in a less concentrated mixture so as to reduce the dielectric constant to 81 over the band of intended use. Alternately, sheath 14 could be a liquid such as distilled water ($\epsilon_2$=78 and tan $\delta$=0.005 at $10^8$ Hertz). If sheath 14 is made from a material in a gaseous or liquid phase rather than one in a solid phase, an additional component, namely a container 19, is necessary to confine the medium 2 to the vicinity of polyrod 16. Although container 19 serves no function other than that of confining a gaseous or liquid phase medium 2, if made of a conducting material (e.g., steel, aluminum), container 19 would tend to act as a cylindrical horn. As shown by FIG. 6, antennas designed for the region between the loosely bound and tightly bound conditions, very little wave energy would be influenced by a metal container 19. Additionally, container 19 may be made of a nonconducting material such as polyethylene. As no electrical function is contemplated for container 19, its thickness is primarily determined by design convenience.

One major advantage of the antenna element of the embodiment described is its broad bandwidth. Referring to FIG. 2, phase velocity is plotted against the rod diameter for materials having various relative dielectric constants in response to only one particular excitation mode. Inherent constraints of the physics of the antenna element and the frequency require the phase velocity in the dielectric rod to approach 100% of its velocity in the waveguide for high gains in the antenna. Relative dielectric constants are determined in the antenna of the preferred embodiment by taking the ratio of the dielectric constant of the rod to that of the waveguide. A dielectric rod having a dielectric constant of 9 ($\epsilon_1$=10) without a surrounding waveguide would than produce a relative dielectric constant of 9 ($\epsilon_r$=9) such as plot 9, FIG. 2, since the dielectric constant of air is approximately equal to 1 ($\epsilon$=1). The bandwidth of such an antenna element would be very narrow since slight changes if $\lambda_o$ (i.e., if medium 2 is air, $\lambda_o=\lambda_2$) as shown in FIG. 2 would cause great changes in the phase velocity and therefore in gain of the antenna.

As shown in FIG. 2, however, relative dielectric constants which approach 1 have very flat responses, asymptotically, approaching a relative phase velocity of 1 which renders high gain antennas with broad bandwidths, clearly an advantageous trait for radar antennas. For example, once a relative dielectric constant of 1.04 ($\epsilon_r = 1.04$) produced by the exemplary embodiment of the present invention is fixed, the wavelength could vary considerably in the horizontal axis, indicating broad bandwidth, and remain within the constraints of the necessary phase velocity for a properly sized rod having very high gain. So the closely matched high valued dielectric constant of the dielectric waveguide not only allows the antenna to be shortened considerably, but renders it a very high gain antenna with broad bandwidth.

EXAMPLE 4

Consider now a double dielectric antenna designed for three hundred megahertz ($\lambda_o = 1$ meter). Rod 16 is made of strontium titanate ($\epsilon_1 = 232$, tan $\delta = 2 \times 10^{-4}$) while sheath 14 is made of calcium titanate ($\epsilon_2 = 169$, tan $\delta = 1 \times 10^{-4}$). Using equation (7), $\lambda_2 = 7.7$ centimeters. Arbitrarily selecting a rod length of six times the wavelength in medium 2, ($6\lambda_2$), both rod 16 and sheath 14 have a length of 46 centimeters (18 inches). The relative dielectric constant between the two material equals 1.39. Selecting the value of $D_1/\lambda_2$ at about 0.8 yields a rod diameter of 6 centimeters (2.5 inches). If gain is set at 40, then:

$$\text{GAIN} = \left[\frac{\pi D_2}{\lambda_2}\right]^2 \tag{8}$$

or the diameter of sheath 14 is 15.5 centimeters (6.1 inches). For the quarter-wave transformer 18, $$\epsilon_m = \sqrt{\epsilon_2\, \epsilon_{air}} = 13. \tag{9}$$

Then, $$\frac{\lambda_g}{4} = \frac{1}{4\sqrt{13}} = 7 \text{ cm.} \tag{10}$$

Figure 9:
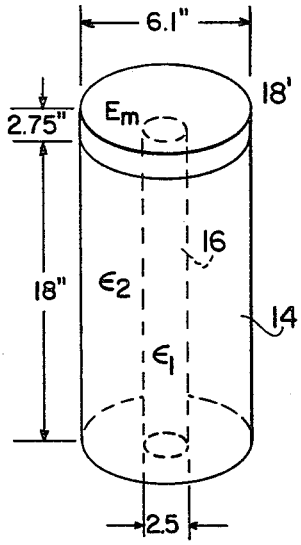
FIG. 9 is an isometric view of an alternate embodiment of a double dielectric antenna.

The length (i.e., "thickness") of transformer 18 is 7 centimeters or 2.75 inches; the width equals the width of sheath 14, about 6.1 inches. A sketch of the embodiment displaying these dimensions is given in FIG. 9.

Figure 10:
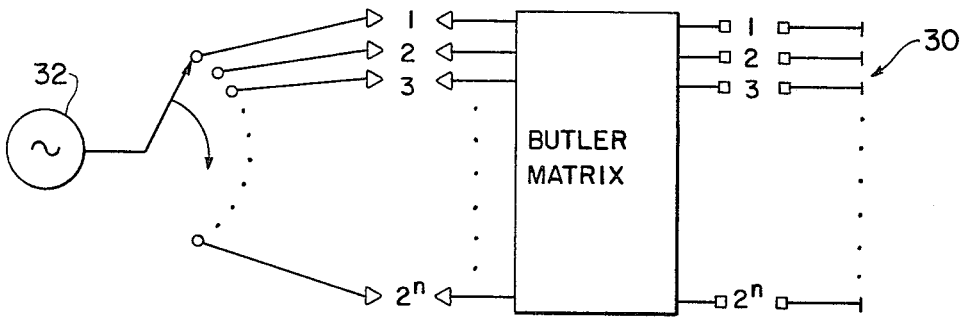
FIG. 10 is a single-line schematic of a circuit incorporating a Butler matrix.

To scan a system of end-fire directive antenna elements, a variation of the Butler matrix is useful. A standard Butler matrix is shown in FIG. 10. It comprises an array of hybrid couplers and fixed phase shifters that have an equal number of binary inputs and outputs. In its usual mode, a linear array of antenna elements 30 are connected to the output terminals. When a microwave power source 32 is connected to one of the input terminals, the matrix distributes the power to all of the outputs with a linear phase shift between adjacent terminals. As the power source is connected to other inputs, the only change in output is the amount of phase shift that exists between adjacent terminals which determines the angle of the output beam. Thus the matrix is capable of producing $2^n$ distinct beam positions in space from the antenna array and each position is uniquely defined by a predetermined input position. Now consider FIG. 11, where the same Butler matrix has been inverted or reversed.

Figure 11:
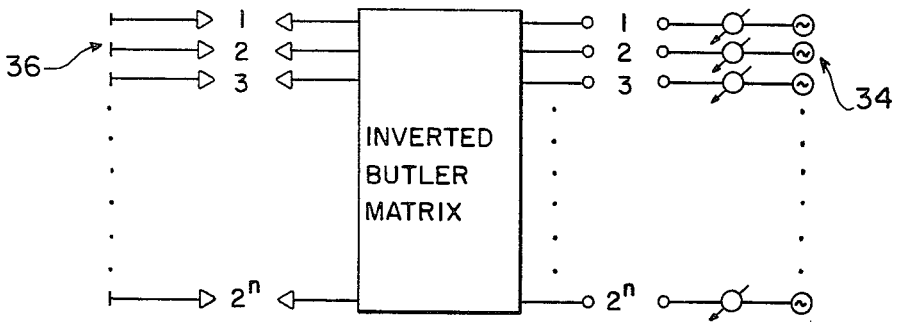
FIG. 11 is a single-line schematic of a circuit incorporating an inverted Butler matrix.

Each of the outputs of the inverted Butler matrix of FIG. 11 is now connected to a coherent power source 34 whose phase can be adjusted electronically. Now, for a given linear phase shift between the oscillators, all of the power of the individual oscillators can be summed to appear at one antenna port of the array of antennas 36. By changing the phase shift, alternate or multiple ports can be selected. In each of the antenna ports is terminated by a narrow element beam antenna element such as the one disclosed above, these beams can be physically positioned to point anywhere in space. The antennas have no dependence on one another and can therefore be mounted in a completely arbitrary manner. The physical destruction of any group of antennas results in a loss of communication only from its assigned space coverage. A loss of any of the low powered input oscillators results in insignificant operational output changes but could easily be detected and pinpointed. While the butler matrix has been used as an illustration, a switching matrix would operate equally well and at first sight appears less cumbersome. The n-multiple oscillators are also not necessary but were included to illustrate how low-powered, solid state oscillators might be included. The problem of mutual impedance and of complex steering commands of the prior art devices therefore disappears completely in this arrangement.

Obviously many modifications and variations of the present invention are possible in light of the above teachings. For example, the element may be used for either transmission or reception, depending upon the particular use desired. In addition, various materials whether in a solid, liquid or gaseous phase, having different dielectric constants than those shown in the exemplary embodiments, may be used for the dielectric rod and for the surrounding sheath. If the sheath is a solid dielectric material for example, it would serve quite suitable as a container for either a gaseous or liquid phase polyrod material.

Radiation is nearly isotropic about the axis of polyrod 16, regardless of whether the cross-section of polyrod 16 is octagonal, square, rectangular, or round. The important design criterion is the avoidance of abrupt transition along the longitudinal surface of polyrod 16; assuming the cross-section of polyrod 16 to be not constant with its length, the dimension of the cross-section must make a smooth or tapered transition between the waveguide feed 10 and the distal end. If this criterion is met, polyrod 16 may have any cross-sectional shape, whether octagonal, rectangular, triangular or round. Similarly, the cross-sectional shape of sheath 14 is not a primary design consideration. If thick enough (e.g., $D_2 \geqq 4a$), the cross-sectional shape of sheath 14 may even be made irregular without significantly affecting performance of a double dielectric antenna. As might be expected, after an examination of FIG. 6, a double dielectric antenna constructed with a polyrod embedded in a measurable thickness of a material forming medium 2, (i.e., sheath 14) having a slightly lesser dielectric constant will provide a narrower beamwidth than one constructed with the same polyrod coated with just a few microns thickness with the same medium 2. The distal end of polyrod 16 may be in intimate contact with the quarter-wave transformer 18, 18' or may be separated by a fractional thickness of medium 2 from transformer 18, 18'.

It is therefore to be understood that within the scope of the appended claims the invention may be practiced otherwise than as specifically described.

What is claimed as new and desired to be secured by Letters Patent of the United States is:

1. An end-fired antenna element for projecting a narrow beam of energy into the surrounding environment, comprising:

feed means terminating in an aperature;

a dielectric rod of a material having a dielectric constant $\epsilon_1$ coupled to the aperture and extending longitudinally therefrom;

a dielectric material surrounding said dielectric rod along the length thereof having a dielectric constant $\epsilon_2 \geqq 81$ and substantially greater than the dielectric constant of the environment but less than the dielectric constant $\epsilon_1$.

2. A directive antenna element, comprising:

feed means for delivering a single mode electromagnetic signal;

a rod connected to the feed means, constructed of a material having a first dielectric constant;

cylindrical material means mounted in the atmosphere and surrounding said rod and constructed of a material having a second dielectric constant $\epsilon_2$ greater than the dielectric constant of the atmosphere but less than the first dielectric constant and the value of the second dielectric constant being not less than eight-one.

3. An antenna element as set forth in claims 1 or 2 wherein said dielectric rod has an actual length $L_a$ and an effective length $L_e$ determined by the formula $L_e = L_a\sqrt{\epsilon_2}$.

4. An end-fired antenna element, comprising:

feed means for delivering a single mode electromagnetic signal;

a rod of a first material having a dielectric constant, $\epsilon_1$, electrically coupled to the feed means;

a sheath of a second material having a dielectric constant, $\epsilon_2$, greater in value than ten but lesser in value than $\epsilon_1$, surrounding the rod;

a quarter wave impedance matching transformer coupling the antenna element to the surrounding environment for end fire, said transformer having a dielectric constant equal to the square root of the product of the dielectric constants of the second material and the surrounding environment;

wherein the ratio $\epsilon_1/\epsilon_2 \geqq 3.0$.

5. The antenna set forth in claim 4 wherein $\epsilon_2 \geqq 25$.

6. The antenna set forth in claim 4 wherein $\epsilon_2 \geqq 30$.

7. The antenna set forth in claim 4 wherein $\epsilon_2 \geqq 50$.

8. The antenna set forth in claim 4 wherein $\epsilon_2 \geqq 81$.

9. A polyrod antenna element having a half-power beamwidth $\theta$, in a surrounding environment comprising:

feed means terminating in a aperture;

a dielectric rod of effective length L extending longitudinally from the feed means and having a dielectric constant $\epsilon_1$, wherein the effective length is defined by the equation $$L = \left[\frac{60}{\theta}\right]^2;$$

a dielectric medium surrounding the rod having a dielectric constant $\epsilon_2$ less than $\epsilon_1$, but substantially greater than the dielectric constant of the surrounding environment, such that:

$$1 < \frac{\epsilon_1}{\epsilon_2} \leqq 2.56$$

whereby the actual length $L_a$ of the rod is defined by the equation:

$$L_a = \frac{L}{\sqrt{\epsilon_2}} \text{;and}$$

a quarter wave impedance matching transformer coupling the antenna element to the surrounding environment for end fire, said transformer having a dielectric constant equal to the square root of the product of the dielectric constants of the dielectric medium and the surrounding environment.

10. A polyrod antenna element having a half-power beamwidth $\theta$ in a surrounding environment, comprising:

feed means terminating in an aperture;

a dielectric rod of effective length L extending longitudinally from the feed means and having a dielectric constant $\epsilon_1$, wherein the effective length is defined by the equation $$L = \left[\frac{60}{\theta}\right]^2;$$

a dielectric medium surrounding the rod having a dielectric constant $\epsilon_2$ less than $\epsilon_1$ but substantially greater than the dielectric constar of the surrounding environment, such that:

$$1 < \frac{\epsilon_1}{\epsilon_2} \leqq 1.04,$$

whereby the actual length $L_a$ of the rod is defined by the equation:

$$L_a = \frac{L}{\sqrt{\epsilon_2}} \text{;and}$$

a quarter wave impedance matching transformer coupling the antenna element to the surrounding environment for end fire, said transformer having a dielectric constant equal to the square root of the product of the dielectric constants of the dielectric medium and the surrounding environment.

11. The antenna element set forth in claims 9 or 10 wherein $\epsilon_1 \geqq 10$.

12. The antenna element set forth in claims 4, 9 or 10 wherein $\epsilon_1 \geqq 25$.

13. In a directive antenna element of the type having in its environment a characteristic three-decibel beamwidth and using a dielectric rod of length L and dielectric constant $\epsilon_1$, extending longitudinally from feed means terminating in an aperture, the antenna element comprising:

material of dielectric constant $\epsilon_2$ surrounding the rod wherein the material is selected according to the formula:

$$1 < \frac{\epsilon_1}{\epsilon_2} \leqq 5.0$$

where $\epsilon_2$ is substantially greater than the dielectric constant of the environment and the value of $\epsilon_2 \geqq 81$.

14. The antenna element set forth in claims 1, 2, 4 or 13 further comprising the dielectric materials selected in accordance with the formula:

$$1 < \frac{\epsilon_1}{\epsilon_2} \leqq 2.56.$$

15. The antenna element set forth in claims 1, 2, 4 or 13 further comprising the dielectric material selected in accordance with the formula:

$$1 < \frac{\epsilon_1}{\epsilon_2} \leqq 1.04.$$

16. The antenna set forth in claims 1, 2, 4, 9, 10 or 13 comprising:

the dielectric rod having a cross-section normal to its greatest dimension that tapers away from the feed means.

17. The antenna set forth in claim 16 further comprised of the taper being linear.

18. The antenna set forth in claim 16 further comprised of the taper being exponential.

19. The antenna set forth in claim 16 further comprised of the taper being described by the formula:

$$a(z) = 1.25 = 0.60e^{-0.62},$$

where a is a cross-sectional dimension and z is a longitudinal dimension.

20. The antenna set forth in claims 4 or 13 wherein the dielectric material surrounding the dielectric rod separates the dielectric rod from a surrounding environment.

21. The antenna set forth in claims 1, 9, 10 or 13 wherein the surrounding environment comprises atmosphere.

22. The antenna set forth in claim 1, 9, 10 or 13 wherein the surrounding environment comprises water.

23. The antenna set forth in claim 14 wherein the dielectric material surrounding the dielectric rod separates the dielectric rod from a surrounding environment.

24. The antenna set forth in claim 14 wherein the surrounding environment comprises atmosphere.

25. The antenna set forth in claim 14 wherein the surrounding environment comprises water.

* * * * *

UNITED STATES PATENT OFFICE

CERTIFICATE OF CORRECTION

Patent No. 4,274,097 Dated June 16, 1981

Inventor(s) Albert D. Krall, Albert M. Syeles

It is certified that error appears in the above-identified patent and that said Letters Patent are hereby corrected as shown below:

On the face of the patent, insert the name of another co-inventor:

(75) Wallace E. Anderson, White Rock, New Mexico

Signed and Sealed this

Fourth Day of May 1982

[SEAL]

Attest:

GERALD J. MOSSINGHOFF

Attesting Officer

Commissioner of Patents and Trademarks